United States Patent [19]

Voigt, Jr.

[11] 4,251,301

[45] Feb. 17, 1981

[54] IMPACT RESISTANT PRESSABLE EXPLOSIVE COMPOSITION OF HIGH ENERGETIC MATERIAL CONTENT

[75] Inventor: H. William Voigt, Jr., Stanhope, N.J.

[73] Assignee: The United States of America as represented by the Secretary of the Army, Washington, D.C.

[21] Appl. No.: 50,378

[22] Filed: Jun. 20, 1979

[51] Int. Cl.[3] ..... C06B 45/24

[52] U.S. Cl. ..... 149/12; 149/88; 149/92

[58] Field of Search ..... 149/12, 88, 92

[56] References Cited

U.S. PATENT DOCUMENTS 3,953,259 4/1976 Sayles ..... 149/92

*Primary Examiner*—Stephen J. Lechert, Jr.

*Attorney, Agent, or Firm*—Nathan Edelberg; Robert P. Gibson; A. Victor Erkkila

[57] ABSTRACT

The impact resistance of particulate RDX and HMX explosives is increased with a minimum loss of explosive output by admixture of about 1 to 9% of a particulate second explosive of the group 1,3,6,8-tetranitrocarbazole, 2,4,6,2′, 4′,6′-hexanitrooxanilide and ammonium picrate. Pressable explosive compositions of even greater impact resistance are obtained by coating the particulate dual explosive with 1 to 5% of a binder, such as petrolatum.

10 Claims, No Drawings

IMPACT RESISTANT PRESSABLE EXPLOSIVE COMPOSITION OF HIGH ENERGETIC MATERIAL CONTENT

GOVERNMENTAL INTEREST

The invention described herein may be manufactured, used, and licensed by or for the Government for Governmental purposes without the payment to me of any royalties thereon.

BACKGROUND OF THE INVENTION

The present invention relates to the preparation of novel explosive compositions containing a crystalline high explosive of the group RDX (known variously as cyclonite, cyclotrimethylenetrinitramine, and 1,3,5-trinitro-1,3,5-triazacyclohexane) and HMX (known as cyclotetramethylenetetranitramine, and 1,3,5,7-tetranitro-1,3,5,7-tetraazacyclooctane), mixed or coated with a minor amount of a second explosive, and preferably containing an added binder.

In the past various methods have been employed to reduce the heat and impact sensitivity of crystalline high explosives, such as RDX. Generally, these methods have involved coating the particles of the high explosive with various inert materials, such as waxes, natural and synthetic resins e.g., polyethylenes, halogenated polyethylenes, rubber, polyurethanes, etc. Such coating materials serve as binders for the particulate high explosives when the compositions are molded under pressure to produce pressed products of good mechanical properties. An important explosive composition of this type used by the military is Composition A3, which consists of 91% RDX coated with 9% of microcrystalline wax. However, although such inert coating materials are effective for reducing the sensitivity of the explosive to impact etc., they also reduce the explosive output of the explosive composition significantly.

It has also been proposed to coat or mix crystalline high explosives such as RDX with small amounts of certain energetic materials, which are effective for reducing the impact sensitivity of the RDX, but unlike inert desensitizing additives, contribute to the explosive output of the composition, such as dinitroethylbenzene (U.S. Pat. No. 3,000,720), TNT (2,4,6-trinitrotoluene), 2,4,6-trinitromethylanilines (U.S. Pat. No. 3,466,205) and polynitro containing polyacrylates (U.S. Pat. No. 3,000,719). U.S. Pat. No. 3,740,278 discloses that the sensitivity of high explosives like RDX can be markedly reduced while essentially maintaining the explosive output of the basic explosive by (1) coating the high explosive particles with 2–8% of a halogenated polyethylene, (2) mixing the coated explosive with 2–8% of a second explosive having a melting point up to 105° C. and a Trauzl lead-block expansion higher than TNT, and (3) compressing the composition at a temperature above the melting point of the second explosive, wherein the second explosive consists of hydrazine nitrate, trinitrophenylethylnitramine, trinitrophenylmethylnitramine, trinitrochlorobenzene and mixtures thereof. From these patents and other observations it is evident that the energetic materials which have been found to be effective for reducing the impact sensitivity of crystalline high explosives, such as RDX, are few in number and vary considerably in their effectiveness and desirability.

SUMMARY OF THE INVENTION

It is a primary object of this invention to provide novel shock resistant, pressable explosives of high energetic material content. Additional objects of the invention will appear hereinafter.

This and other objects and advantages are unexpectedly achieved by the novel pressable explosive compositions of this invention, which comprise (1) a mixture of about from 90% to 99% by weight of at least one particulate first explosive selected from the group consisting of 1,3,5-trinitro-1,3,5-triazacyclohexane (RDX), 1,3,5,7-tetranitro-1,3,5-tetraazacyclooctane (HMX), and about from 1 to 9% of at least one particulate second explosive having a melting point above 250° C. selected from the group consisting of 1,3,6,8-tetranitrocarbazole (TNC), 2,4,6,2',4',6'-hexanitrooxanilide (HNO), and ammonium picrate; and (2) about from 1 to 5% by weight of said mixture of a binder, such as petrolatum.

DETAILED DESCRIPTION OF THE INVENTION

The novel explosive compositions of this invention can be produced by preparing a mixture of from 90% to 99% by weight of particulate RDX and/or HMX and 1 to 9% of a particulate second explosive defined above in aqueous medium, agitating the aqueous mixture until a smooth blend is obtained, and evaporating the mixture to dryness. The particulate RDX or HMX employed preferably possesses an average particle size not exceeding about 50 microns and particularly about 10 microns, although the invention can be effectively accomplished with RDX of HMX having an average particle size up to about 800 microns. However, the use of RDX/HMX having an average particle size substantially exceeding 200 microns is less preferred, since crystals of larger size tend to fracture in processing, exposing sensitive explosive surfaces. The particulate second explosives employed generally are finer, e.g. about from 1 to 5 microns and preferably are precoated with a small amount, e.g. 0.05 to 0.5% by weight of a polyvinylpyrrolidone (PVP), which increases the processing safety of the explosive by reducing static electricity in known manner, and may assist in attracting the particles of the second explosive to the RDX/HMX particles. Polyvinylpyrrolidones having molecular weights ranging from about 40,000 to 400,000 are suitable.

The binder, e.g. petrolatum, can be coated on or incorporated with the particulate dual explosive, comprising a mixture of 90% to 99% RDX and/or HMX and 1 to 9% of the aforesaid second explosive, in conventional manner, as by adding the mixture to a solution of the binder in a suitable solvent, and removing the solvent by evaporation to precipitate the binder on the particulate explosives. The amount of binder employed is generally about 1 to 5% and preferably about 3% by weight of the mixture of RDX/HMX and aforesaid second explosive. Amounts greater than 5% of added binder or greater than about 9% of the aforesaid second explosive are less desirable, since they provide no significant additional increase in impact resistance and reduce the explosive output of the explosive composition unduly; and amounts less than 1% of the binder or second explosive provide a relatively small effect and hence are less desirable for practical use.

Petrolatum is the preferred binder, since in combination with the second explosive it has been unexpectedly found to provide a large additional increase in the impact resistance of the RDX explosive beyond that obtained with the aforesaid second explosives per se. Petrolatum is a conventional binder which is known variously as petroleum jelly, paraffin jelly, etc., and is a purified mixture of semisolid hydrocarbons of the methane series of the general formula $C_nH_{2n+2}$—see the Merck Index, Ninth Edition, No. 6970. However, binders previously employed and suitable for coating and desensitizing crystalline RDX or HMX explosives can be utilized alone or in mixtures with petrolatum or each other for producing the novel explosive compositions. The resulting compositions containing a binder can be pressed in conventional manner to produce molded tablets of good mechanical properties. Suitable binders include natural and synthetic resins and waxes, e.g. beeswax, petroleum waxes such as microcrystalline wax, polyethylenes, polypropylenes, chlorinated and/or fluorinated polyethylenes and—polypropylenes, polyurethanes, acrylic resins, dialkyladipates, polyvinylpyrrolidones, etc. Also, the aforesaid second explosives of the present invention can be employed together with other energetic materials, which themselves may or may not be effective for desensitizing RDX or HMX.

The following examples provide further specific illustrations of the explosive compositions of this invention. In the examples, parts and percentages stated are by weight.

EXAMPLE 1

Part A Preparation of RDX coated with 0.1% PVP.

47.5 parts of RDX, Class E Holston 42-57, having an average particle size of about 10 microns, were stirred into a solution of 0.05 part of polyvinyl pyrrolidone (PVP) of mol. wt. 90,000 in 30 parts of water at 90° C. The mixture was heated with agitation at 90° C. in an open vessel to evaporate most of the water.

Part B Preparation of a RDX/PVP/TNC Explosive Powder.

2.5 parts of TNC (principally 1,3,6,8-tetranitrocarbazole) having an average particle size of 2 microns, were added to the damp product obtained in Part A. Twenty parts of water were then added and the mixture thus obtained was heated and agitated at 90° C. until most of the water had evaporated, and the damp product was dried on a tray in an atmospheric steam drier.

Part C Preparation of an RDX/PVP/TNC powder coated with 3% petrolatum.

Ten parts of the RDX/TNC explosive powder obtained in Part B were stirred into a solution of 0.3 parts of petrolatum* in 8.3 parts of methylene chloride. The resulting mixture was allowed to stand at room temperature until the methylene chloride was completely evaporated. A free-flowing powder having an average particle size of approximately 10 microns, was obtained.

*The petrolatum employed was Petrolatum, FSN6505-133-8025, marketed by Purelene White Oils, Inc., Paterson, N.J. It corresponds to Merck Index, Ninth Edition, No. 6970, Petrolatum.

EXAMPLE 2

Preparation of a RDX/PVP/$NH_4$ picrate powder coated with 3% petrolatum.

The procedure described in Example 1, Parts B and C was repeated except that ammonium picrate (Explosive D) was employed in place of TNC. The ammonium picrate, unlike TNC, was soluble in the water and formed a dye coating on the RDX particles after evaporation of the water.

EXAMPLE 3

Part A Preparation of RDX coated with 0.1% PVP.

50 parts of Class E RDX having the same particle size as in Example 1, were stirred into a solution of 0.05 part of polyvinyl pyrrolidone (mol. wt. 90,000) in 30 parts of water. The mixture was heated with agitation in an open vessel at 95° C. until most of the water had evaporated and the damp product was dried on a tray at 100° C.

Part B Preparation of RDX/PVP/HNO explosive powder.

47.5 parts of the RDX coated with 0.1% PVP obtained in Part A were stirred into a mixture of 2.5 parts of 2,4,6,2',4',6'-hexanitrooxanilide (HNO), having an average particle size of 3 microns, and 30 parts of water at 90° C. (the HNO was partially soluble in the water). The resulting thixotropic slurry was heated and agitated at 90° C. until most of the water had evaporated and the damp product was dried on a tray at 100° C. in a steam oven.

Part C Preparation of a RDX/PVP/HNO powder coated with 3% petrolatum.

10 parts RDX/HNO explosive powder obtained in Part B was coated with 0.3 parts of petrolatum in the manner described in Example 1, Part C.

Part D Use of polypropylene in place of petrolatum.

The procedure described in Part C was repeated except that the petrolatum wax was replaced by an equal amount of a low mol. wt. polypropylene wax.

Part E

The procedure described in Part C was repeated using 3% of a 50/50 mixture of the petrolatum and Estane (See Example 5.) in place of petrolatum.

Part F

The procedure described in Part C was repeated using 3% of a 50/50 mixture of neopentyl adipate and Carboset 525 dissolved in alcohol in place of petrolatum. Carboset is a thermoplastic, film-forming acrylic resin containing 5-10% free carboxylc acid groups, marketed by B. F. Goodrich Chemical Co.

EXAMPLE 4

Preparation of a RDX/PVP/TNO powder coated with 3% petrolatum.

The procedure described in Example 3, Parts B and C was repeated except that 2,4,2',4'-tetranitrooxanilide (TNO) having an average particle size of about 3 microns was employed in place of HNO.

EXAMPLE 5

Preparation of RX/PVP/TNC powder coated with 3% Estane.

A solution of 1.5 parts of Estane 5702 in 21 parts of methyl ethyl ketone was stirred into a mixture of 50 parts of the RDX/PVP/TNC powder, obtained as described in Example 1, Part B, and 25 parts of water. Seventy-five parts of cold (8° C.) water were added to the resulting mixture with agitation to cause precipitation of the Estane as a coating on the particles. The mixture was then filtered and the filter cake was washed twice with 50 parts of cold water and dried at 85° C. Estane is a tradename for a thermoplastic polyurethane elastomer, prepared by reacting a polyester diol and toluene diisocyanate or diphenylmethane diisocyanate and manufactured by the B. F. Goodrich Co.

EXAMPLE 6

Preparation of a RDX/PVP/DATNB powder.

The procedure described in Example 3, Part B was repeated except that 1,3-diamino-2,4,6-trinitrobenzene (DATNB), having an average particle size of about 6 microns, was employed in place of the HNO.

EXAMPLE 7

Preparation of RDX/PVP/Petrolatum Explosive Powder.

Ten parts of the PVP coated RDX obtained as described in Example 3, Part A were coated with 0.3 part of petrolatum in the manner described in Example 1, Part C.

Table 1 sets forth a comparison of the results of impact shock sensitivity tests obtained with (a) the explosive compositions prepared in the foregoing examples and (b) the untreated RDX and second explosives employed as well as other control explosives.

the impact resistance of the RDX when employed therewith in similar manner. Also, HNO substantially increases the impact resistance of the RDX even though it possesses the same impact sensitivity as RDX, whereas TNO does not increase the impact resistance of RDX even though it is slightly more resistant to impact than RDX.

(2) The addition of 3% petrolatum to the compositions containing 95% RDX+0.1% PVP+5% TNC, HNO or ammonium picrate provides a considerable and unexpected further increase in impact resistance. In fact, the increase in impact resistance thus obtained is greater than that obtained by addition of petrolatum to the PVP coated RDX per se. Also, the increase in impact resistance obtained by addition of petrolatum to the RDX composition containing 5% TNC is outstanding (namely 30–31 in. versus 20 in. when the petrolatum is omitted) and is considerably greater than that obtained by use of the other binders employed.

Compositions produced according to Example 1 consisting of 95% RDX, 5% TNC, and 3% added petrolatum were pressed in a die to produce strong tablets of various densities according to the pressure applied. The calculated explosive outputs of these pressed compositions are compared in Table 2 with those of RDX and a corresponding RDX/petrolatum composition containing no TNC.

TABLE 1

| Example | | Explosive Composition | | *PA Impact Sensitivity Test, Inches | % Binder | Example | | *PA Impact Sensitivity Test, Inches |
|---|---|---|---|---|---|---|---|---|
| | | RDX employed, per se | | 16 | | | | |
| | | DATB per se | | 35+ | | | | |
| | | $NH_4$ picrate per se | | 28 | | | | |
| | | TNC per se | | 25 | | | | |
| | | TNO per se | | 18 | | | | |
| | | HNO per se | | 16 | | | | |
| 1 | Part A | 95% RDX + 0.1% PVP | +5% TNC | 21 | +3% Estane | 5 | | 22 |
| 1 | Part B | " | +5% TNC | 21 | +3% petrolatum | 1 | Part C | 30–31 |
| 2 | | " | +5% $NH_4$ picrate | 20 | " | 2 | | 23 |
| 3 | Part A | RDX + 0.1% PVP | | 17 | " | 7 | | 20 |
| 3 | Part B | 95% RDX + 0.1% PVP | +5% HNO | 21 | " | 3 | Part C | 25 |
| | " | " | +5% HNO | 21 | +3% low mol. wt. polypropylene | 3 | Part D | 22 |
| | " | " | +5% HNO | 21 | +3% petrolatum/ Estane (50—50) | 3 | Part E | 25 |
| | " | " | +5% HNO | 21 | +3% Carboset 525/neopentyl adipate | 3 | Part F | 23 |
| 4 | | " | +5% TNO | 16 | +3% petrolatum | 4 | | 23 |
| 6 | | " | +5% DATB | 17 | | | | |

*The Picatinny Arsenal Impact Sensitivity Test is described in "Standard Laboratory Procedures for Sensitivity, Brisance and Stability of Explosives," PATR No. 1401, March 18, 1944, Revised February 28, 1950, W. H. Rinkenbach and A. J. Clear. The first indication of no detonation was recorded as the height of the 2kg drop weight on the confined explosive.

The results show that (1) A mixture of 5% of TNC, HNO, or ammonium picrate with 95% RDX coated with 0.1% PVP provides explosive compositions possessing significantly greater impact resistance than that possessed by the 0.1% PVP coated RDX employed. (The 0.1% PVP provides essentially no increase in impact resistance.) This increased impact resistance was not obvious, since the results show that there is no correlation between the impact values of TNC, HNO, and $NH_4$ picrate per se and the ability of those explosives to increase the impact resistance of RDX. Thus, as shown in the table, the TNC and $NH_4$ picrate per se exhibit PA impact values of 25 and 28 in., which are considerably higher than 16–17 in. obtained with the RDX per se or RDX containing 0.1% PVP. By contrast, DATNB, which exhibits a high PA impact value of 35 in., does not increase

TABLE 2

| COMPOSITION | DENSITY | DETONATION VELOCITY |
|---|---|---|
| | g/cc | m/sec |
| RDX | 1.802 (crystal) | 8755 |
| 97/3RDX/petrolatum | 1.746 (Theo.) | 8521 |
| 95/5/3RDX/TNC/petrolatum | 1.5 | 7550 |
| " | 1.6 | 7909 |
| " | 1.7 | 8281 |
| " | 1.8 | 8666 |

The invention can also be advantageously utilized with the commonly available coarse RDX, Class A Holston 77G-870.001, having an average particle size of ca. 180 microns, which is employed in the pressed military explosive known as Composition A3, consisting of 91% RDX and 9% microcrystalline wax. Composition A3 possesses the required shock resistance, i.e. PA impact value of 20 inches, but requires therefor a substantial amount (9%) of the inert wax, which results in a substantial reduction in the explosive output (detonation pressure) of the explosive composition. The following example shows that an explosive composition possessing equal impact resistance but increased explosive output compared to Composition A3 can be obtained by selecting an efficient inert material, and then replacing most of this inert material with a finely divided second explosive defined above.

EXAMPLE 8

7 parts of finely divided ammonium picrate were stirred into a solution of 1 part PVP (mol. wt. 90,000) and 1 part of neopentyl adipate plasticizer in 20 parts of 95% Ethanol. 91 parts of RDX, having an average particle size of about 180 microns and precoated with 0.1% PVP, were then added and the resulting mixture was stirred until a homogeneous mixture was obtained. The mixture was then dried at 55° C. The product thus obtained exhibited a PA impact sensitivity value of 20 ins.

The foregoing disclosure is merely illustrative of the principles of this invention and is not to be interpreted in a limiting sense. I wish it to be understood that I do not desire to be limited to the exact details of construction shown and described, because obvious modifications will occur to a person skilled in the art.

What is claimed is:

1. An explosive composition comprising a mixture of about from 90% to 99% by weight of at least one particulate first explosive selected from the group consisting of 1,3,5-trinitro-1,3,5-triazacyclohexane and 1,3,5,7-tetranitrol,3,5,7-tetraazacyclooctane and about from 1 to 9% of at least one particulate second explosive selected from the group consisting of 1,3,6,8-tetranitrocarbazole and, 2,4,6,2',4',6',-hexanitrooxanilide.

2. An explosive composition according to claim 1, wherein the crystalline high explosive is 1,3,5-trinitro-1,3,5-triazacyclohexane and the second explosive is -1,3.6,8-tetranitro-carbazole.

3. An explosive composition according to claim 1, wherein about from 1 to 5% of a binder, based on the weight of the mixture of said crystalline high explosive and said second second explosive, is incorporated.

4. An explosive composition according to claim 3, wherein the binder is selected from the group consisting of petroleum waxes, polyurethanes, polyethylenes, polypropylenes, acrylic resins, polyvinylpyrrolidones and dialkyl adipates.

5. An explosive composition according to claim 3, wherein the binder consists essentially of petrolatum.

6. An explosive composition according to claim 3, wherein the crystalline explosive is 1,3,5,-trinitro-1,3,5-triazacyclohexane.

7. An explosive composition according to claim 3, wherein the second explosive is 1,3,6,8-tetranitrocarbazole.

8. An explosive composition according to claim 3, wherein the mixture contains about 95% of the crystalline high explosive and about 5% of the second explosive and the amount of binder is about 3%.

9. An explosive composition according to claim 8, wherein the high explosive is 1,3,5-trinitro-1,3,5-triazacyclohexane, the second explosive is 1,3,6,8-tetranitrocarbazole and the binder is petrolatum.

10. An explosive composition according to claim 3, wherein the high explosive is coated with about 0.05 to about 0.5% by weight of polyvinylpyrrolidone.

* * * * *